US011374351B2

(12) United States Patent
Storione et al.

(10) Patent No.: US 11,374,351 B2
(45) Date of Patent: Jun. 28, 2022

(54) MULTIPOLAR CONNECTOR

(71) Applicant: FISCHER CONNECTORS HOLDING S.A., Saint-Prex (CH)

(72) Inventors: Savino Storione, Saint-Prex (CH); Nicolas Convert, Saint-Prex (CH); Jean-Marie Buchilly, Saint-Prex (CH)

(73) Assignee: FISCHER CONNECTORS HOLDING S.A., Saint-Prex (CH)

( * ) Notice: Subject to any disclaimer, the term of this patent is extended or adjusted under 35 U.S.C. 154(b) by 0 days.

(21) Appl. No.: 17/045,385

(22) PCT Filed: Apr. 5, 2019

(86) PCT No.: PCT/IB2019/052818
§ 371 (c)(1),
(2) Date: Oct. 5, 2020

(87) PCT Pub. No.: WO2019/193564
PCT Pub. Date: Oct. 10, 2019

(65) Prior Publication Data

US 2021/0159633 A1 May 27, 2021

(30) Foreign Application Priority Data

Apr. 6, 2018 (WO) ..... PCT/IB2019/052390

(51) Int. Cl.
*H01R 13/52* (2006.01)
*H01R 12/71* (2011.01)
(Continued)

(52) U.S. Cl.
CPC ..... *H01R 13/521* (2013.01); *H01R 12/714* (2013.01); *H01R 13/2407* (2013.01); *H01R 13/502* (2013.01)

(58) Field of Classification Search
CPC ..... H01R 13/6205; H01R 13/521; H01R 13/2407; H01R 13/502; H01R 12/714
See application file for complete search history.

(56) References Cited

U.S. PATENT DOCUMENTS 2,824,290 A 2/1958 Archer et al.
2,892,991 A 6/1959 Beebee et al.
(Continued)

FOREIGN PATENT DOCUMENTS

CN 102299438 A 12/2011
CN 104170184 11/2014
(Continued)

OTHER PUBLICATIONS

International Search Report for PCT/IB2019/052818 dated Jun. 4, 2019, 6 pages.
(Continued)

*Primary Examiner* — Abdullah A Riyami
*Assistant Examiner* — Nader J Alhawamdeh
(74) *Attorney, Agent, or Firm* — Nixon & Vanderhye P.C.

(57) ABSTRACT

A connector comprising a substantially cylindrical base and a plug connectable to the base in a detachable manner, in which connector a plurality of contacts are mounted in a contact block, wherein the contact block includes a flexible membrane through which the contacts extend, the compression of the membrane allowing the sealing at the interface between the membrane and the contacts to be ensured.

22 Claims, 5 Drawing Sheets

(51) Int. Cl.
*H01R 13/24* (2006.01)
*H01R 13/502* (2006.01)

(56) References Cited

U.S. PATENT DOCUMENTS

| | | | | |
|---|---|---|---|---|
| 3,112,975 | A | 12/1963 | Hamel | |
| 3,237,147 | A | 2/1966 | Etal | |
| 3,521,216 | A | 7/1970 | Tolegian | |
| 4,601,528 | A | 7/1986 | Spier | |
| 5,114,361 | A | 5/1992 | Houtteman | |
| 5,413,508 | A | 5/1995 | Obara | |
| 5,509,821 | A | 4/1996 | Small et al. | |
| 5,554,042 | A | 9/1996 | Denninger | |
| 5,704,792 | A | 1/1998 | Sobhani | |
| 5,803,750 | A | 9/1998 | Purington et al. | |
| 5,865,638 | A | 2/1999 | Trafton | |
| 6,243,870 | B1 | 6/2001 | Graber | |
| 6,331,117 | B1 | 12/2001 | Brundage | |
| 6,395,985 | B1 | 5/2002 | Djeddah | |
| 6,422,903 | B1 | 7/2002 | Fekonja et al. | |
| 6,716,048 | B2 | 4/2004 | Collin et al. | |
| 6,719,578 | B1 | 4/2004 | Klassen et al. | |
| 6,895,261 | B1 | 5/2005 | Palamides | |
| 6,945,805 | B1 | 9/2005 | Bollinger | |
| 7,151,455 | B2 | 12/2006 | Lindsay et al. | |
| 7,462,035 | B2 | 12/2008 | Lee et al. | |
| 7,658,612 | B2 | 2/2010 | Lee et al. | |
| 8,490,525 | B2 | 7/2013 | Wilson et al. | |
| 8,496,494 | B2 * | 7/2013 | Jordan | H01R 9/032 439/349 |
| 8,961,191 | B2 | 2/2015 | Hanshew | |
| 9,054,445 | B2 | 6/2015 | O'Sullivan et al. | |
| 9,300,083 | B2 | 3/2016 | Bosscher et al. | |
| 9,502,822 | B1 | 11/2016 | Huang | |
| 9,847,609 | B2 | 12/2017 | Planard-Luong | |
| 10,574,006 | B2 * | 2/2020 | Storione | H01R 13/6276 |
| 2001/0018277 | A1 | 8/2001 | Gerard et al. | |
| 2001/0034152 | A1 | 10/2001 | Harris | |
| 2002/0003931 | A1 | 1/2002 | Cairns et al. | |
| 2002/0019177 | A1 | 2/2002 | Bartholomew | |
| 2002/0168889 | A1 | 11/2002 | Adduci | |
| 2003/0027435 | A1 | 2/2003 | Schneider et al. | |
| 2003/0057698 | A1 | 3/2003 | Parrott et al. | |
| 2003/0162431 | A1 | 8/2003 | Schmidt et al. | |
| 2004/0038596 | A1 * | 2/2004 | Bartholoma | H01R 13/648 439/752 |
| 2004/0166740 | A1 | 8/2004 | Jorgensen | |
| 2005/0148241 | A1 | 7/2005 | Kohen | |
| 2006/0051999 | A1 | 3/2006 | Allemann et al. | |
| 2006/0110977 | A1 | 5/2006 | Matthews | |
| 2006/0128169 | A1 | 6/2006 | Marmaropoulos et al. | |
| 2007/0026695 | A1 | 2/2007 | Lee et al. | |
| 2007/0085023 | A1 | 4/2007 | Debroche et al. | |
| 2007/0087612 | A1 | 4/2007 | Tsujita | |
| 2007/0244422 | A1 | 10/2007 | Chiodo | |
| 2008/0214040 | A1 | 9/2008 | Holterhoff et al. | |
| 2008/0233785 | A1 | 9/2008 | Yaworski et al. | |
| 2009/0149086 | A1 | 6/2009 | Dahms | |
| 2009/0280673 | A1 | 11/2009 | Kohen | |
| 2009/0291579 | A1 | 11/2009 | Farole et al. | |
| 2010/0075512 | A1 | 3/2010 | Lai | |
| 2010/0100997 | A1 | 4/2010 | Lee et al. | |
| 2010/0259293 | A1 | 10/2010 | Seifried | |
| 2010/0291802 | A1 | 11/2010 | Sawai et al. | |
| 2011/0021049 | A1 | 1/2011 | Ramasubramanian et al. | |
| 2011/0098601 | A1 | 4/2011 | Huynh et al. | |
| 2012/0028489 | A1 | 2/2012 | Gramsamer et al. | |
| 2012/0052721 | A1 | 3/2012 | Watson | |
| 2012/0089002 | A1 | 4/2012 | Mackie | |
| 2012/0319398 | A1 | 12/2012 | Schweizer et al. | |
| 2013/0102182 | A1 | 4/2013 | Ijima | |
| 2013/0183866 | A1 | 7/2013 | Poulain et al. | |
| 2013/0288501 | A1 | 10/2013 | Russell et al. | |
| 2013/0344724 | A1 | 12/2013 | Song et al. | |
| 2014/0073176 | A1 | 3/2014 | Plant et al. | |
| 2014/0106589 | A1 | 4/2014 | Genta et al. | |
| 2014/0130329 | A1 | 5/2014 | Changsrivong et al. | |
| 2014/0134871 | A1 | 5/2014 | Jozwik et al. | |
| 2014/0179148 | A1 | 6/2014 | Huang | |
| 2014/0199896 | A1 * | 7/2014 | Jordan | H01R 13/6277 439/855 |
| 2014/0273543 | A1 | 9/2014 | Hanshew | |
| 2015/0093921 | A1 | 4/2015 | Lewin | |
| 2015/0093931 | A1 | 4/2015 | Burrow et al. | |
| 2015/0162674 | A1 | 6/2015 | Nishikawa et al. | |
| 2015/0325943 | A1 | 11/2015 | Frey et al. | |
| 2015/0340805 | A1 * | 11/2015 | Jordan | H01R 13/6456 439/338 |
| 2016/0056585 | A1 | 2/2016 | Dunwoody et al. | |
| 2016/0099527 | A1 | 4/2016 | Loveless et al. | |
| 2016/0211627 | A1 | 7/2016 | Planard-Luong | |
| 2016/0380380 | A1 | 12/2016 | Koepsell | |
| 2017/0104280 | A1 | 4/2017 | Edmonds et al. | |
| 2017/0141507 | A1 | 5/2017 | Tucker | |
| 2017/0264049 | A1 | 9/2017 | Tiberghien et al. | |
| 2017/0331207 | A1 | 11/2017 | Lappoehn | |
| 2018/0054017 | A1 | 2/2018 | Watkins et al. | |
| 2018/0069342 | A1 | 3/2018 | Kasar et al. | |
| 2018/0138685 | A1 | 5/2018 | Sandell et al. | |
| 2018/0212359 | A1 * | 7/2018 | Wei | H05K 1/181 |
| 2018/0223888 | A1 | 8/2018 | Nguyen | |
| 2018/0323556 | A1 * | 11/2018 | Storione | H01R 35/04 |
| 2019/0067859 | A1 | 2/2019 | Sugiura | |
| 2019/0360847 | A1 | 11/2019 | Tanner et al. | |
| 2021/0159633 | A1 * | 5/2021 | Storione | H01R 13/2407 |

FOREIGN PATENT DOCUMENTS

| | | | | |
|---|---|---|---|---|
| CN | 106299871 | | 1/2017 | |
| CN | 205911563 | U | 1/2017 | |
| CN | 106877088 | A | 6/2017 | |
| CN | 106998009 | A | 8/2017 | |
| CN | 206619765 | U | 11/2017 | |
| DE | 37 22 196 | | 1/1989 | |
| DE | 41 35 679 | | 5/1993 | |
| EP | 0021864 | A1 | 1/1981 | |
| EP | 1843440 | A1 | 10/2007 | |
| EP | 1988607 | A2 | 11/2008 | |
| EP | 2 144 336 | | 3/2011 | |
| EP | 2 461 429 | | 6/2012 | |
| EP | 2 533 374 | | 12/2012 | |
| EP | 2 806 508 | | 11/2014 | |
| EP | 2806508 | A1 * | 11/2014 | H01R 13/17 |
| FR | 1 354 923 | | 3/1964 | |
| FR | 2 456 406 | | 12/1980 | |
| FR | 2 690 569 | | 10/1993 | |
| FR | 2930683 | A1 | 10/2009 | |
| FR | 3 010 245 | | 3/2015 | |
| JP | H02-052287 | U | 4/1990 | |
| KR | 2013-0039691 | A | 4/2013 | |
| KR | 10-1795298 | B1 | 11/2017 | |
| WO | 97/02630 | | 1/1997 | |
| WO | 2005/053100 | A2 | 6/2005 | |
| WO | 2006/060772 | A2 | 6/2006 | |
| WO | 2011/118917 | A2 | 9/2011 | |
| WO | 2012/112580 | | 8/2012 | |
| WO | 2013/175720 | A1 | 11/2013 | |
| WO | 2015/028953 | | 3/2015 | |
| WO | 2017/030573 | A1 | 2/2017 | |
| WO | 2017/072620 | | 5/2017 | |
| WO | 2017/159155 | | 9/2017 | |

OTHER PUBLICATIONS

Written Opinion of the ISA for PCT/IB2019/052818 dated Jun. 4, 2019, 8 pages.

* cited by examiner

MULTIPOLAR CONNECTOR

This application is the U.S. national phase of International Application No. PCT/IB2019/052818 filed Apr. 5, 2019 which designated the U.S. and claims priority to International Patent Application PCT/IB2018/052390 filed Apr. 6, 2018, the entire contents of each of which are hereby incorporated by reference.

CORRESPONDING APPLICATION

The present application claims priority to the earlier application number PCT/IB2018/052390, filed on Apr. 6, 2018 in the name of Fischer Connectors Holding SA, the content of this earlier application being incorporated by reference in its entirety in the present patent application.

FIELD OF THE INVENTION

The present invention relates to connectors, in particular multipolar electric connectors, that are used, for example, in the field of electric wiring. For example, the connectors in question are used for/in fields of application requiring both reliability and flexibility, such as applications of the wearable type, for example clothing or equipment for people moving in difficult environments (workers, emergency services, soldiers and security forces, etc.) or any other similar use.

PRIOR ART

In most cases, the use of a multipolar connector requires having the two main components of the connector (for example, a component containing male contacts, for example, a plug, and a component with female contacts, for example, a socket) connected together following a specific and predetermined angular orientation. This constraint may be achieved using particular shapes of the components allowing a connection according to a predetermined relative position, or by other equivalent technical means (such as asymmetrical constructions, interlocking elements, etc.).

However, having to align one component with respect to the other one before connecting them is inconvenient for the user. This inconvenience is particularly notable if the components of the connector cannot be seen by the user when the connection is made (for example due to a lack of light or in a position hidden from view), or when the connection must be made quickly.

There is therefore a need to be able to overcome this inconvenience.

International application WO 2017/072620 discloses a multipolar connector aiming to overcome these problems, the content of this previous application being incorporated by reference in the present application.

The connector described in this previous application comprises a substantially cylindrical shaped socket and a plug, which may be removably or detachably connected to the socket, with a plurality of contacts being disposed in said plug. The socket comprises a disc-shaped conductive face, on or in which at least one conductive track is disposed forming at least one arc of a circle, the center of which substantially coincides with the center of the conductive face, said track also being disposed so as to form a mechanical-electrical coupling with one of said contacts of the plug when the plug and the socket are connected.

In the particular configuration that comprises only one circular track, the center of the surface of the socket is a conductor disc, which is disposed so as to form an electric coupling with a contact of the plug disposed at the center thereof.

Preferably, the disclosed connector comprises several circular conductive tracks, which are disposed concentrically. In general, the number of tracks is equal to the number of contacts, but in embodiments, their number may differ. This construction and its various embodiments are applicable to the connector according to the present invention.

GENERAL DESCRIPTION OF THE INVENTION

The present invention aims to offer improvements to the known connectors, and in particular to the connector disclosed in WO 2017/072620, notably with respect to the fluid-tightness of said connector in order to allow its use in unfavorable environments (damp, dusty, etc.), among others things.

One embodiment of the present invention relates to a contact block 1 acting as a connector or being able to be reversibly (detachable) integrated in a connector in order to transmit any electric signal through the connector.

This block is highly sealed and allows the function of transmitting the signal to be guaranteed in unfavourable environments, for example, with pressurized fluids (such as water), dust, ice, etc.

More specifically, in one embodiment, the invention relates to a contact block for a connector, the block comprising at least one flexible membrane traversed by contacts, wherein said flexible membrane allows the seal to be provided at the interface between said membrane and the contacts.

In a particular embodiment, the compression of the membrane allows this seal to be provided at the interface between said membrane and the contacts through the deformation of the membrane during compression.

In another embodiment, the aim is to obtain the adhesion of the membrane and of the contacts by a bond of the physicochemical type, for example, a glueing or other equivalent means, such as surface treatments.

In embodiments, the electric contacts have a degree of freedom allowing them to both exert a force on a part of the connector acting as a counter-part and positioned opposite the block, as well as to have independence of movement with each other. The counter-part may be the socket of a connector, for example.

In embodiments, the contacts are of the "piston contact" type, for example.

In embodiments, the block is connected to a PCB or to other equivalent connection means.

In embodiments, each contact of the block is axially freely mounted, preferably independently of the other contacts.

In embodiments, the contacts may or may not be distributed asymmetrically.

In embodiments, the invention relates to a plug or a socket for a connector comprising at least one block as disclosed in the present application.

In embodiments, the plug may or may not be angled.

In embodiments, the invention relates to a connector comprising at least one block and/or one plug or socket as disclosed in the present application.

In embodiments, the connector may comprise a socket, on which the plug is connected.

In embodiments, the plug may be connected such that it rotates freely around the socket.

In embodiments, the plug may be connected according a limited number of orientations about the socket.

In embodiments, the block comprises a plurality of contacts and the socket comprises a plurality of conductive tracks. The tracks are preferably of circular shape and are disposed concentrically.

In embodiments, the number of tracks of the socket is equal to the number of contacts of the plug. In embodiments, their number may be different.

In embodiments, the contacts may be on the socket and the tracks may be on the plug.

In embodiments, the connector according to the invention comprises a locking system allowing the rotation of the plug to be blocked relative to the socket and/or said rotation to be limited and/or the unplugging of the plug on the socket to be blocked, for example, below a certain traction force threshold.

In embodiments, the invention relates to an object comprising at least one socket as disclosed in the present application and combined with a plug and/or a block as disclosed in the present application. The assembly forms an object connected by means of the connector formed by the socket and the plug. The object is, for example, a "wearable" object, such as a jacket or a harness or another piece of clothing.

DETAILED DESCRIPTION OF THE INVENTION

The invention will be better understood from the following description of various embodiments and technical features thereof, said embodiments being given as non-limiting examples.

In general, in an embodiment, the connector according to the present invention is similar to the one disclosed in application WO 2017/072620 in that it comprises a socket and a plug, the plug being detachably connected to the socket, as disclosed in this previous application, which is incorporated by reference in the present application.

Figure 1:
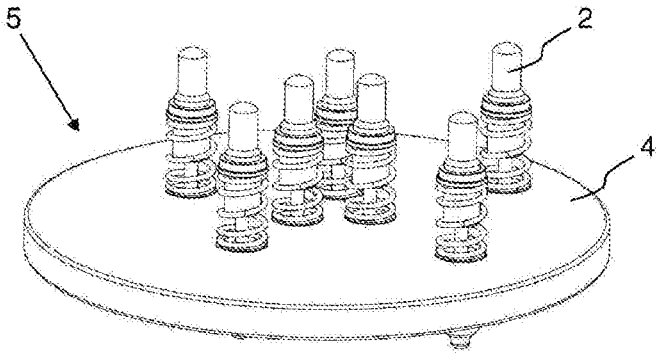
FIG. 1 illustrates a perspective view of a sub-assembly according to an embodiment.

FIG. 1 firstly illustrates a sub-assembly 5 comprising a flexible membrane 4, in which electric contacts 2 are mechanically assembled. Of course, the number of illustrated contacts 2 is an illustrative example and the sub-assembly may comprise at least one single contact 2 or a plurality of contacts 2 (that is less than or more than the number shown in FIG. 1).

The electric contacts 2 preferably have a degree of freedom allowing them to both exert a force on a counter-part positioned opposite the block 1 (that is, for example, a socket 3) and to have independence of movement between each other in order to maintain optimal individual connection properties.

These contacts 2 therefore are mechanically assembled in a flexible membrane 4 so as to form an independent "membrane-contacts" sub-assembly 5, as illustrated in FIG. 1. They may be inserted into the membrane 4, or the membrane may be overmolded on the contacts 2, for example. In one embodiment, there may be a physicochemical contact bond between the membrane 4 and the contacts 2 in order to create the seal.

Figure 2:
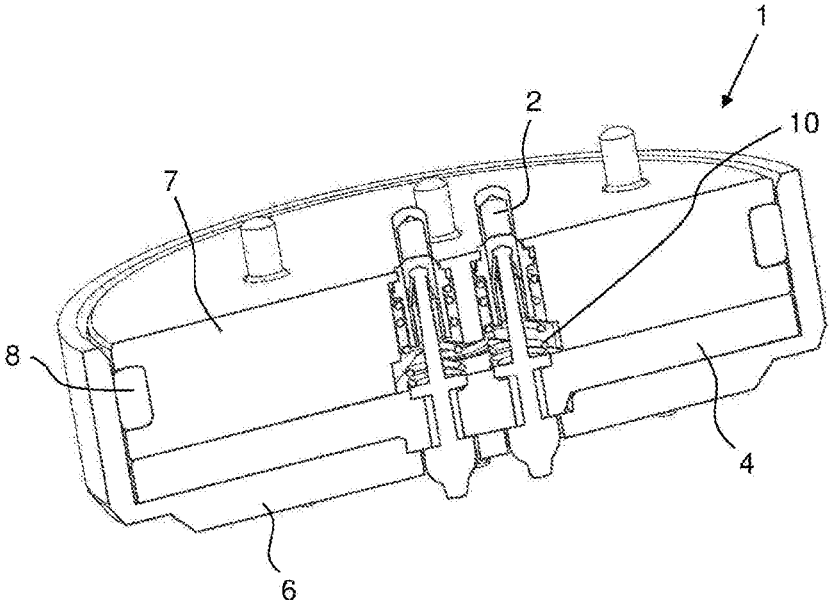
FIG. 2 illustrates a section view of a contact block according to an embodiment.

As illustrated in FIG. 2, the sub-assembly 5 is then encapsulated in a container comprising two insulating parts 6, 7 (for example, manufactured from synthetic materials) exerting, once connected together by any type of means (screwing, clipping, force fitting, gluing, etc.), an axial force on the flexible membrane 4, which is created during the encapsulation. This axial force compresses the membrane and results in the deformation of the flexible membrane 4 in a direction that is essentially perpendicular to that of said force (by this compression between the two parts 6, 7), which allows the seal to be provided between the contacts 2 and the flexible membrane 4, with the membrane, due to its deformation, forcibly conforming to the external shape of the contacts 2. Consequently, a better seal is provided for the system by this force that is applied on the membrane 4 and its deformation in the direction that is essentially perpendicular to that of the compression. More specifically, the membrane deforms by compressing in the direction parallel to that of the axial force and by expanding in the direction perpendicular to that of the axial force, which provides the desired seal around the contacts 25.

The flexible membrane 4 may be produced by any type of means (for example, 3D printing, injection, overmolding, etc.) and from any type of synthetic materials (such as elastomers), so as to withstand chemical agents, for example. The same is the case for the two insulating parts 6, 7, which may, for example, be manufactured from high-performance, thermoplastic or thermohardened materials.

The assembly 1 thus formed is denoted "contact block", see FIG. 2.

The seal between the two assembled insulating parts 6, 7 may be provided by an O-ring type seal 8 or by any other equivalent means (for example, gluing), see FIG. 2.

Figure 3:
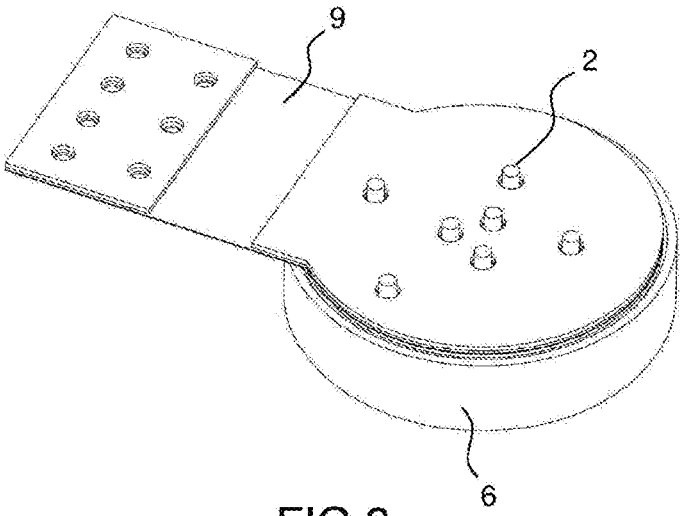
FIG. 3 illustrates a perspective view of a contact block connected to a flexible PCB according to an embodiment.

The contact block 1 may or may not be permanently connected to the external environment by connecting the contacts 2 to wires, to a cable, to a flexible or rigid PCB 9, see FIG. 3, or any other component allowing the desired function to be fulfilled.

Such a contact block 1 according to the invention has the advantage of forming an independent sub-assembly that may be used in any type of connector or connection.

It is also considered to be very easy to clean, with the front face of the block 1 having a highly advantageous geometry in this respect, in particular with respect to the mechanical strength formed by the insulating part 6, which allows the contacts to be protected.

The contacts 2 may be of the "piston contact" type, so that the contact block forms a set of sealed piston contacts, thus resolving the major sealing problem of this type of contact, namely the possibility of seizing due to the ingress of particles or of fluids.

In the event that the contact block integrates "piston contacts", the membrane 4, which acts as an electrical insulator, is directly connected to the movable part of the contact, thus granting it protection against the ingress of liquids or solids, with the junction of the movable part and of the fixed part of the contact being located inside the sealed cavity 10.

Figure 4:
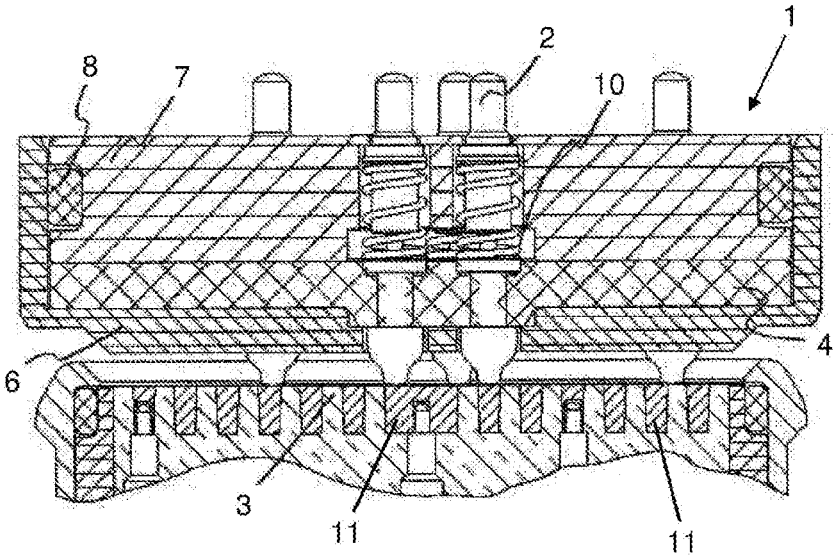
FIG. 4 illustrates a section view of a plug connected to a socket according to an embodiment.
Figure 5:
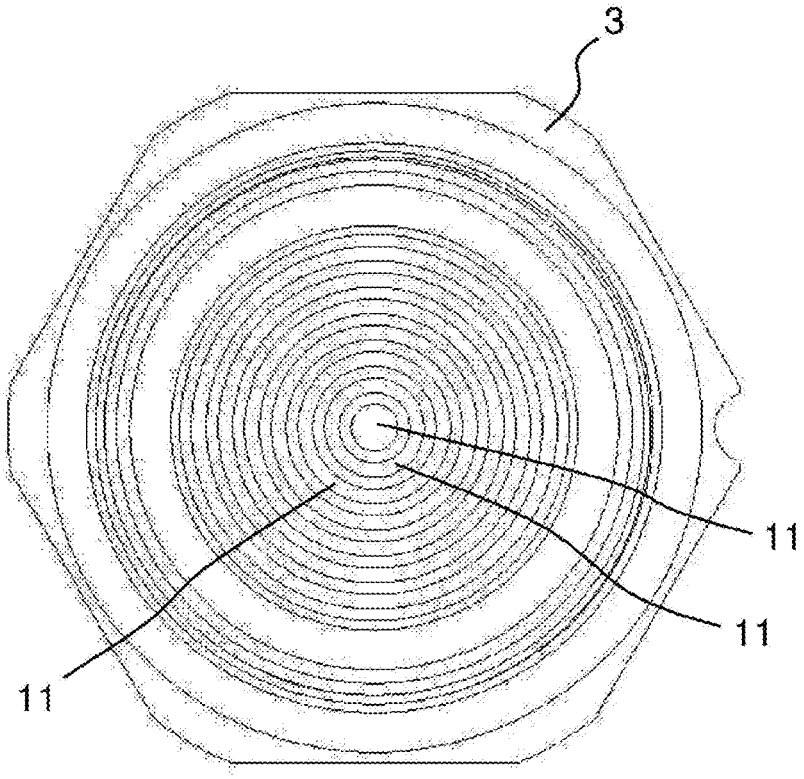
FIG. 5 illustrates a socket according to an embodiment of the present invention.

FIG. 4 illustrates the connection of a block 1 to a socket 3. Typically, the socket 3 and the plug 12 containing the block 1 may be of the type disclosed in WO 2017/072620. By way of an example, FIG. 5 illustrates an example of a top view of such a socket 3, with circular and concentric tracks 11.

Figure 6:
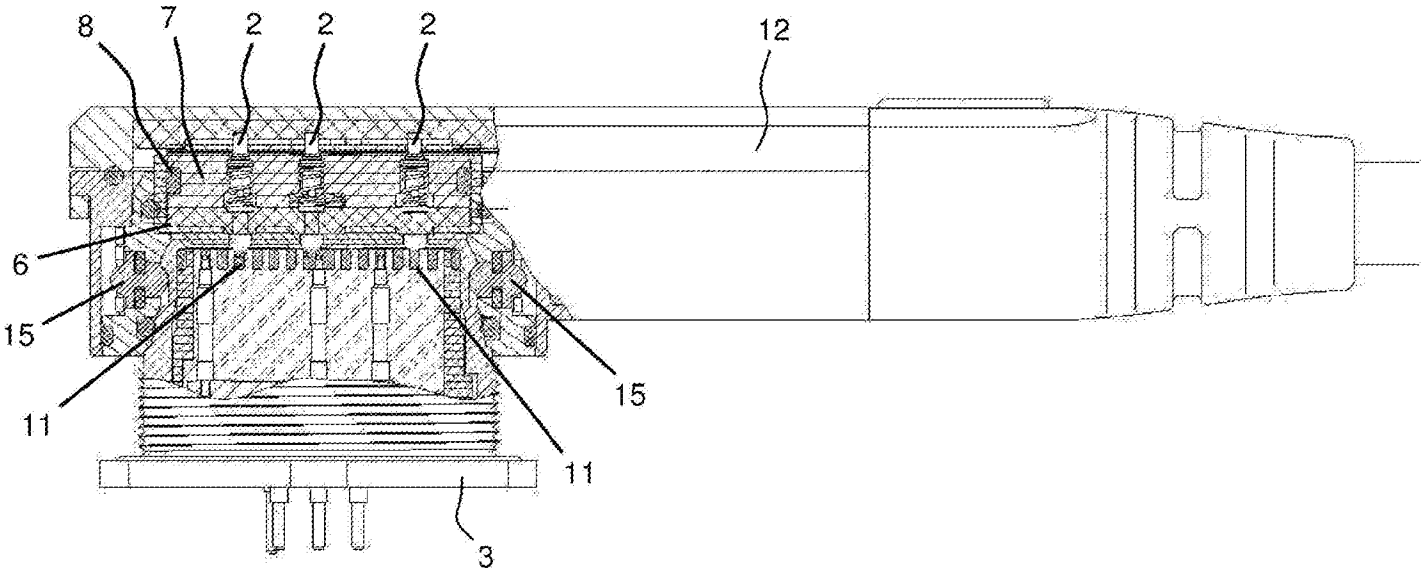
FIG. 6 illustrates a plug and a socket connected according to an embodiment of the present invention.

FIG. 6 illustrates a plug 12 and a socket 3 connected according to the principles of the present invention. The plug 12 particularly comprises a block 1 as disclosed with reference to the preceding figures, with its insulating parts 6 and 7 and the seal 8. The plug 12 also comprises contacts 2, which are in contact with the tracks 11 of the socket, according to the principles of WO 2017/072620.

Naturally, the invention is not limited to this configuration. It also covers connectors comprising at least one contact.

Similarly, the connector according to the invention may assume any dimensions.

The connector according to the invention is unique in that it does not require prior orientation of the plug (for example, a wired element) relative to the socket 3 (for example, an appliance casing element, or on a product such as a garment 13 or other product). This advantage results from the cylindrical/circular geometry of the socket and of its conductive face (see, for example, FIG. 1 of WO 2017/072620). Once connected, the relative rotation between the socket 3 and the plug 12 may be free or blocked by means of a suitable system, for example, of the bi-stable type for the sake of citing a non-limiting example, for example, locking using lateral pressure and unlocking using axial pressure, a system of notches or even a manually activated system. A blockage between the plug 12 and the socket 3 also may be implemented to block the "unplugging" of the plug 12. An example is the system called "push-pull" system. These means also may be implemented in a combined use, i.e. to limit or to block the relative rotation, and also to block unplugging.

Figure 8:
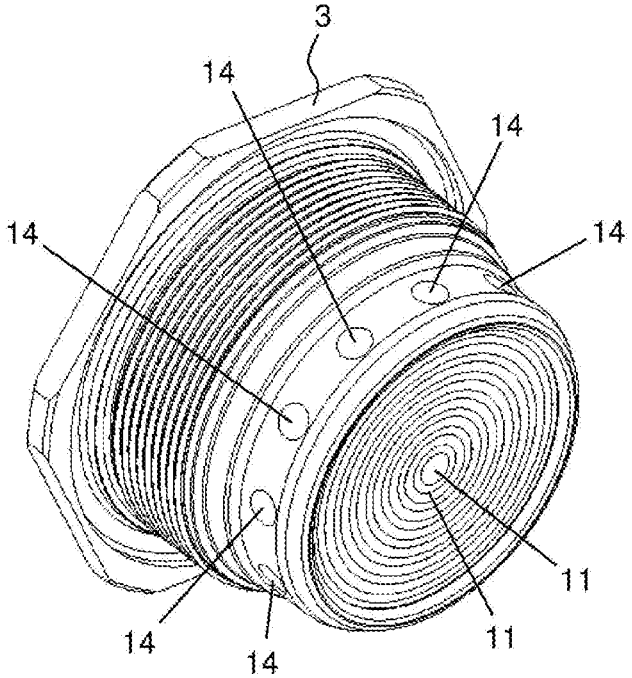
FIG. 8 illustrates an embodiment of a socket with blocking means.

An orientation nevertheless may be provided and limit the possibilities of plugging to a finite number of different angular positions (for example, four separate 90° positions or 12 separate 30° positions), as disclosed in FIG. 2 of WO 2017/072620. FIG. 8 illustrates a socket 3 with tracks 11 and an example of blocking means between the socket 3 and the plug 12. In this example, these means comprise housings 14, in which balls 15 of the plug 12 (see FIG. 6) may be housed in order to block or limit the relative rotation between the plug 12 and the socket 3 and/or to prevent unplugging (for example, below a certain traction force).

Figure 7:
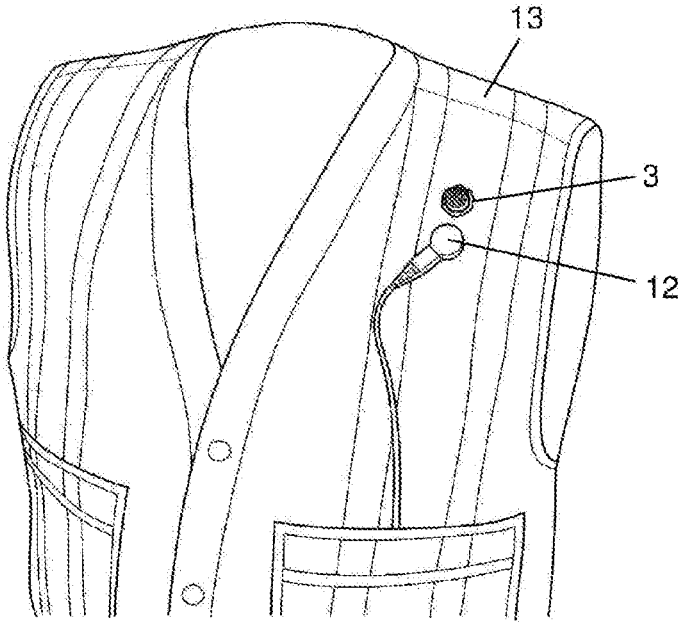
FIG. 7 illustrates an object comprising a connector according to an embodiment of the present invention.

FIG. 7 illustrates an example of the use of a connector according to the present invention. In this non-limiting example, the socket 3 is fixed on a vest 13 and the plug 12 is ready to be connected to the socket 3 in order to assume the configuration of FIG. 6.

Of course, the invention is not limited to the embodiments and examples that are disclosed in the present application by way of a non-limiting illustration. Alternative embodiments are possible within the scope of the conferred and claimed protection, in particular by using equivalent means. The embodiments also may be combined together and technical features of one of the embodiments may be used in another embodiment.

For example, in embodiments, the construction of the plug and of the socket is reversed, i.e. the contacts 2 may be on the socket 3 and the tracks 11 may be on the plug 12. In this case, the construction disclosed in the present application is used but is reversed, namely elements of the plug 12 (particularly illustrated in FIGS. 1 to 4) are placed on/in the socket 3 and elements of the socket 3 (in particular the tracks 33, housings 14, FIG. 7) are placed on/in the plug 12. By way of an example illustrating these embodiments, in FIG. 4, the upper part may form part of the socket and the lower part may form part of the plug. The principles of the present invention as disclosed herein do not change and are correspondingly applicable to these embodiments.

Of course, other alternative embodiments may be contemplated within the scope of the present invention.

The invention claimed is:

1. A contact block for a connector, the contact block comprising:

a first insulating part;

a second insulating part;

a flexible membrane having traversing holes;

a plurality of electric contacts, the flexible membrane is traversed by the plurality of contacts at respective ones of the traversing holes, wherein side walls of the plurality of electric contacts are in direct contact with side walls of the corresponding traversing holes of the flexible membrane to provide for a seal between the plurality of contacts and the flexible membrane.

2. The contact block according to claim 1, wherein the first insulating part and the second insulating part are arranged to compress the flexible membrane therebetween such that the flexible membrane is deformed in a direction substantially perpendicular to a direction of compression, to provide for the seal between the plurality of electric contacts and the flexible membrane.

3. The contact block according to claim 1, wherein the seal includes a physicochemical bond provided between the flexible membrane and the plurality of electric contacts.

4. The contact block according to claim 1, wherein each one of the plurality of electric contacts is configured to provide for a degree of freedom allowing to both exert a force on a counter-part positioned opposite the contact block and provide an independence of movement between different electric contacts.

5. The contact block according to claim 1, wherein at least one of the plurality of electric contacts includes a piston-type contact.

6. The contact block according to claim 1, the contact block configured to be connected to a printed circuit board (PCB).

7. The contact block according to claim 1, wherein each one of the plurality of electric contacts is configured for a free axial movement that is independent of an axial movement of the other contacts.

8. The contact block according to claim 1, wherein each one of the plurality of electric contacts are asymmetrically distributed or not in the flexible membrane.

9. The contact block according to claim 1, wherein the first and second insulating parts form a container, a second seal provided between the first and second insulating parts to seal the container, the container having the flexible membrane located therein.

10. The contact block according to claim 1, wherein the plurality of contacts also traverse the first insulating part, a second seal provided between the first and the second insulating parts.

11. A connector part having a contact block, the contact block comprising:

a first insulating part;

a second insulating part;

a flexible membrane having traversing holes; and a plurality of electric contacts, the flexible membrane is traversed by the plurality of contacts at respective ones of the traversing holes, wherein side walls of the plurality of electric contacts are in direct contact with side walls of the corresponding traversing holes of the flexible membrane to provide for a seal between the plurality of contacts and the flexible membrane.

12. The connector part according to claim 11, wherein the contact block includes a plug or a socket.

13. The connector part according to claim 12, wherein the contact block includes an angled plug.

14. A connector comprising a plug and a socket, the plug or the socket having a connector part as claimed in claim 11.

15. The connector according to claim 14, wherein the plug and the socket are configured to allow for a rotation relative to each other.

16. The connector according to claim 14, wherein the plug is configured to be connected according to a limited number of orientations relative to the socket.

17. The connector according to claim 14, wherein each on the plurality of electric contacts of the plug or the socket includes a concentrically arranged circular conductive track.

18. The connector according to claim 14, wherein each on the plurality of electric contacts of the socket or the plug includes an electrically conductive pin.

19. The connector according to claim 14, further comprising:

a locking system configured to allow a rotation of the plug to be blocked or limited relative to the socket.

20. The connector part according to claim 11, wherein the first insulating part and the second insulating part are arranged to compress the flexible membrane therebetween such that the flexible membrane is deformed in a direction substantially perpendicular to a direction of compression, to provide for the seal between the plurality of electric contacts and the flexible membrane.

21. The connector part according to claim 11, wherein the first and second insulating parts form a container, a second seal provided between the first and second insulating parts to seal the container, the container having the flexible membrane located therein.

22. The connector part according to claim 11, wherein the plurality of contacts also traverse the first insulating part, a second seal provided between the first and the second insulating parts.

* * * * *